US011438686B2

(12) United States Patent
Tiefenau

(10) Patent No.: US 11,438,686 B2
(45) **Date of Patent: *Sep. 6, 2022**

(54) EARPIECE FOR DETERMINING STATE OF CLOSING ELEMENT FOR VENT

(71) Applicant: GN Hearing A/S, Ballerup (DK)

(72) Inventor: Andreas Tiefenau, Gammel Holte (DK)

(73) Assignee: GN HEARING A/S, Ballerup (DK)

( * ) Notice: Subject to any disclaimer, the term of this patent is extended or adjusted under 35 U.S.C. 154(b) by 0 days.

This patent is subject to a terminal disclaimer.

(21) Appl. No.: 16/949,087

(22) Filed: Oct. 13, 2020

(65) Prior Publication Data

US 2021/0029439 A1 Jan. 28, 2021

Related U.S. Application Data

(63) Continuation of application No. 16/690,085, filed on Nov. 20, 2019, now Pat. No. 10,805,711.

(30) Foreign Application Priority Data

Dec. 14, 2018 (EP) ..... 18212535

(51) Int. Cl.
*H04R 1/10* (2006.01)
*H04R 29/00* (2006.01)

(52) U.S. Cl.
CPC ..... *H04R 1/1041* (2013.01); *H04R 1/1016* (2013.01); *H04R 1/1058* (2013.01); *H04R 29/001* (2013.01); *H04R 2460/11* (2013.01)

(58) Field of Classification Search
USPC ..... 381/23.1, 74, 309, 312, 367, 376
See application file for complete search history.

(56) References Cited

U.S. PATENT DOCUMENTS 6,549,635 B1 * 4/2003 Gebert ..... H04R 25/456 381/324
2014/0169603 A1 * 6/2014 Sacha ..... H04R 25/60 381/324

FOREIGN PATENT DOCUMENTS

EP 0 684 750 A2 11/1995
EP 0 684 750 A3 11/1995
(Continued)

OTHER PUBLICATIONS

Notice of Allowance for U.S. Appl. No. 16/690,085 dated Jun. 10, 2020.

(Continued)

*Primary Examiner* — Yosef K Laekemariam
(74) *Attorney, Agent, or Firm* — Vista IP Law Group, LLP

(57) ABSTRACT

A system comprising an earpiece, the earpiece having a first end facing a tympanic membrane, and a second end facing toward a surrounding of a user when the earpiece is worn by the user, includes: a vent channel coupled to a first vent opening at the first end, and to a second vent opening at the second end, wherein the vent channel comprises a vent port; a closing element comprising a first magnetic member, the closing element configured to cause the vent port to be open, and to cause the vent port to be closed; an inductive member comprising a conductive material, the inductive member configured for inductive coupling with a second magnetic member, wherein the second magnetic member is configured for displacing the closing element by magnetic interaction with the first magnetic member; and a processor configured to obtain an electrical measurement value of the second magnetic member.

20 Claims, 6 Drawing Sheets

(56) References Cited

FOREIGN PATENT DOCUMENTS

| | | | | |
|---|---|---|---|---|
| EP | 2835987 | * | 6/2013 | ..... H04R 25/00 |
| EP | 2 835 987 A1 | | 2/2015 | |
| EP | 3 471 432 A1 | | 4/2019 | |

OTHER PUBLICATIONS

Extended European Search Report dated Jun. 25, 2019 for corresponding European Application No. 18212535.1.
Extended European Search Report dated Jun. 25, 2019 for related European Application No. 18212555.9.

* cited by examiner

EARPIECE FOR DETERMINING STATE OF CLOSING ELEMENT FOR VENT

RELATED APPLICATION DATA

This application is a continuation of U.S. patent application Ser. No. 16/690,085, filed on Nov. 20, 2019, now U.S. Pat. No. 10,805,711, which claims priority to, and the benefit of, European Patent Application No. 18212535.1 filed on Dec. 14, 2018. The entire disclosures of the above applications are expressly incorporated by reference herein.

FIELD

The present disclosure relates to an earpiece and a system comprising an earpiece for an ear canal of a user. The earpiece is configured for sealing the ear-canal of the user wearing the earpiece. The earpiece has a first end, the first end facing a tympanic membrane of the ear canal of the user when the earpiece is worn by the user. The earpiece has a second end, the second end facing toward the surroundings of the user when the earpiece is worn by the user. The earpiece comprises a vent channel coupled to a first vent opening positioned at the first end and a second vent opening positioned at the second end. The vent channel comprises a vent port. The earpiece comprises a closing element. The closing element comprises a first magnetic member. The closing element is configured for being in a first state or in a second state, wherein in the first state the closing element causes the vent port to be open, and in the second state the closing element causes the vent port to be closed.

BACKGROUND

Earpieces for hearing devices may comprise a vent channel with a vent opening for venting the ear canal of the user wearing the earpiece. The vent is for allowing for pressure equalization between the ear canal and the surroundings to reduce or avoid the occlusion effect.

However, there is a need for an improved earpiece and improved system comprising an earpiece.

SUMMARY

Disclosed is a system comprising an earpiece for an ear canal of a user. The earpiece is configured for sealing the ear-canal of the user wearing the earpiece. The earpiece has a first end, the first end facing a tympanic membrane of the ear canal of the user when the earpiece is worn by the user. The earpiece has a second end, the second end facing toward the surroundings of the user when the earpiece is worn by the user. The earpiece comprises a vent channel coupled to a first vent opening positioned at the first end and a second vent opening positioned at the second end. The vent channel comprises a vent port. The earpiece comprises a closing element. The closing element comprises a first magnetic member. The closing element is configured for being in a first state or in a second state, wherein in the first state the closing element causes the vent port to be open, and in the second state the closing element causes the vent port to be closed. The earpiece comprises an inductive member comprising a conductive material. The inductive member is configured in a fixed relationship with the closing member and is configured for inductive coupling with a second magnetic member. The second magnetic member is configured for displacing the closing element by magnetic interaction with the first magnetic member. The system comprises a processor being communicatively coupled to the second magnetic member and configured for obtaining an electrical measurement value of the second magnetic member. The processor is configured for determining the state of the closing element based on the electrical measurement value of the second magnetic member.

It is an advantage that the closing element can be in two different states providing that the vent port is either open or closed.

The fixed relationship between the inductive member and the closing element provides that when the closing element moves the inductive member relative to the second magnetic member, the inductive coupling between the second magnetic member and the inductive member changes, and thereby the electrical measurement value of the second magnetic member changes accordingly.

It is an advantage that the electrical measurement value, e.g. electrical impedance, of the second magnetic member changes, because the electrical measurement value can be measured or detected, and thereby a detected change in the electrical measurement value indicates that the state of the closing element has changed, i.e. changed from the first state to the second state or vice versa, and thus the vent port is changed from being open to closed or vice versa. Thus, the measured electrical measurement value will provide information of whether the vent port is open or closed.

The inductive coupling between the inductive member and the second magnetic member may change the electrical measurement value of the second magnetic member dependent on the state of the closing element. Thus, if the closing element is in the first state, the vent port is open, and the electrical measurement value will have one value, such as a first value. If the closing element is in the second state, the vent port is closed, and the electrical measurement value will have another value, such as a second value. The first value may be higher or lower than the second value.

For example, the electrical measurement value, e.g. impedance, may be higher if the inductive member is closer to the second magnetic member. This may for example be the case, when the vent port is open.

In another example, the electrical measurement value, e.g. impedance, may be lower if the inductive member is closer to the second magnetic member. This may for example be the case, when the vent port is open.

In yet another example, the electrical measurement value, e.g. impedance, may be higher if the inductive member is further from the second magnetic member. This may for example be the case, when the vent port is closed.

In yet another example, the electrical measurement value, e.g. impedance, may be lower if the inductive member is further from the second magnetic member. This may for example be the case, when the vent port is closed.

The second magnetic member is configured for displacing the closing element by magnetic interaction with the first magnetic member. The displacement may be between the first state and the second state.

The system comprises a processor being communicatively coupled to the second magnetic member and configured for obtaining an electrical measurement value of the second magnetic member. The electrical measurement value may be obtained by measurement. The processor is configured for determining the state of the closing element based on the electrical measurement value of the second magnetic member.

It is an advantage that the processor can determine the state of the closing element based on the electrical measurement value, e.g. electrical impedance, as this may save battery, since an additional sensor may not be required for determining the state of the closing element.

It is an advantage that the processor can set the state of the closing element by applying a suitable current or voltage to the second magnetic member, thereby changing the electrical measurement value.

In an embodiment, the processor may be configured for detecting that the system and/or the earpiece and/or closing element is in a third state. In the third state, the closing element is neither in the open state nor in the closed state, thus the vent port is neither open nor closed. In the third state, the closing element may be between the open state and the closed state, such that the vent port may be half-open or half-closed, such as partially open. The processor may be configured to determine that the closing element is in the third state, being between the first state and the second state, if a third difference between the electrical measurement value and a third threshold value is smaller than the first difference, and the third difference is smaller than the second difference.

In an embodiment, the third threshold value is between the first threshold value and the second threshold value.

In an embodiment, the third state may be used to enable a partially open vent port. The processor may receive an input from a user indicating that the vent port should be partially open, e.g. received via an external communication device communicatively coupled to the system or a button on the system or the like. The processor may determine that the vent port should be partially open based on a sound environment detected by the system or any other parameter detectable by the system. Based on the input and/or the determination, the processor may be configured to control the second magnetic member to displace the closing element from the first state to the second state or from the second state to the first state until the processor detects that the closing element is in the third state. Thereby, the vent may be set in a partially open state i.e. the third state.

In an embodiment, the third state may be substantially halfway between the first state and the second state, such as within 5% of halfway between the first state and the second state, such as within 10% of halfway between the first state and the second state, such as within 15% of halfway between the first state and the second state.

In an embodiment, the third threshold may be substantially half a sum of the first threshold and the second threshold, such as within 5% of half the sum of the first threshold and the second threshold, such as within 10% of half the sum of the first threshold and the second threshold, such as within 15% of half the sum of the first threshold and the second threshold.

In an embodiment, the processor may be configured for error detection by detecting that the system and/or the earpiece and/or closing element is in the third state. Thus, this enables error detection if the processor determines that the closing element is in a third state i.e. neither open nor closed.

It is an advantage that the processor is configured for error detection by comparing the set state with the determined state of the closing element.

The set state of the closing element may be set e.g. in a user interface, by the user of the hearing device in which the earpiece is arranged. If the user wishes to stream audio in the hearing device, the user may set the hearing device in a streaming mode, and the vent port of the earpiece should be closed, when the hearing device is in streaming mode. Thus, the closing element should be in the second, closed, state.

If instead, the user sets the hearing device in e.g. a normal mode or hear-through mode, the vent port of the earpiece should be open. Thus, the closing element should be in the first, open, state.

It is thus an advantage that the processor may determine the actual state of the closing element based on the measured electrical measurement value of the second magnetic member. If the processor determines that the closing element is in the first state, but the closing element is set in the second state or vice versa, this is an error that can be detected.

The actual state of the closing element and the set state of the closing element may be different or opposite, for example if the displacement or movement of the closing element is blocked. Dirt or earwax can block the movement of the closing element.

Thus, the processor may detect a mode of operation of the earpiece or hearing device, and the processor may set the mode of the operation via the closing element. The user of the hearing device may determine which mode of operation the hearing device, and thus the earpiece, should be in. For example, the user can use a user interface, e.g. using an app on a connected smart phone, and/or using mechanical push buttons on the hearing device itself. The hearing device may determine which mode of operation is suitable, e.g. based on acoustic detection, based on the presence of the audio from a connected smart phone etc.

The mode can be a streaming mode with the vent port closed. The mode can be a listening mode with the vent port open. Other modes may be possible.

The processor may be configured for receiving a user input setting the mode of operation and/or setting the state of the closing element. The user input may be received via a user interface.

It is an advantage that the earpiece is able to open and close the vent port because when the user speaks, the vent port can be open thus reducing and/or eliminating the occlusion effect while when the user is silent and listen to an ambient signal e.g. another person speaking, the vent port can be closed thus enabling a higher sound pressure to be built up in the ear canal.

It is an advantage to have the vent port open for allowing for pressure equalization between the ear canal and the surroundings to reduce or avoid the occlusion effect.

However, if the user, wearing the hearing device with the earpiece, wishes to stream audio in the hearing device, e.g. listening to music, the sound may be bad if the earpiece has an open fitting, i.e. if the first port of the earpiece is open. Therefore, it is an advantage to have the vent port closed, when the user is streaming audio in the hearing device, as a closed first port provides good sound for the user.

Thus, it is an advantage that the first magnetic member of the closing element of the earpiece can be used for controlling whether the vent port should be open or closed, and/or for detecting whether the vent port is open or closed.

Due to the magnetic properties of the first magnetic member of the closing element, it can be detected, by electrical measurement, which state the closing element is in, and thus it can be detected whether the vent port is open or closed.

Furthermore, as the earpiece is configured to be arranged in the ear of the user, dirt or earwax may enter the earpiece and potentially block the closing element. Thus, it is an advantage that the state of the closing element can be detected, thereby detecting whether the vent port is open or closed, for checking whether the closing element has been blocked.

The closing element is configured for being in a first state or in a second state. The first state may be a first position. Thus, the closing element may be in a first position in the receiver channel. The second state may be a second position. Thus, the closing element may be in a second position in the receiver channel. In the first state or position, the closing element causes the vent port to be open. Thus, the closing element ensures that the vent port is open, or the closing element opens the vent port. In the second state, the closing element causes the vent port to be closed. Thus, the closing element ensures that the vent port is closed, or the closing element closes the vent port.

The closing element comprising the first magnetic member may be an actuator, such as a magnetic actuator, which can be moved inside the receiver channel by applying a magnetic field to a second magnetic member. The second magnetic member may attract or repel the first magnetic member of the closing element, when a magnetic field is applied, thereby moving the closing element. Moving the closing element provides that the closing element changes or switches between the first state and the second state. Changing the state of the closing element provides that the vent port changes between being open or closed.

The earpiece is for a hearing device.

The hearing device may be a hearing aid configured for compensating for a hearing loss of the user.

The hearing device may be an ear protection device or a hearing protection device.

The hearing device may be a noise protection device.

The hearing device may be for audio streaming of e.g. music, phone calls, etc.

The hearing device may be configured for one or more of hearing loss compensation, noise protections, ear protection, hearing protection, audio streaming etc.

The hearing device may be an in-the-ear (ITE) hearing device, in-the-canal (ITC) hearing device, completely-in-canal (CIC) hearing device, or invisible-in-the-canal (IIC) hearing device.

The hearing device may be a receiver-in-the-ear (RITE) hearing device, receiver-in-the-ear (RIE) hearing aid, or a receiver-in-canal (RIC) hearing device. The hearing device may be a behind-the-ear (BTE) hearing device, e.g. where the receiver is arranged in a housing configured to be positioned behind the ear of a user.

BTE hearing devices may comprise a case, which hangs behind the pinna. The case may be attached to the earpiece or to a dome tip by a traditional tube, slim tube, or wire. The tube or wire may extend from the superior-ventral portion of the pinna to the concha, where the earpiece or dome tip inserts into the external auditory canal. The case may contain the electronics, controls, battery, and microphone(s). The loudspeaker, or receiver, may be housed in the case, e.g. a traditional BTE, or in the earpiece or dome tip, e.g. a receiver-in-the-canal (RIC).

The earpiece may have an earpiece shell. The earpiece shell has an outer surface. The outer surface may be configured to fit into the ear canal of a user of the earpiece.

The earpiece may extend along an axis. The axis may be parallel to the longitudinal direction of the earpiece.

The earpiece has a first end, also called tip end (distal end) with a tip surface facing a tympanic membrane of the user when worn by the user. The axis may perpendicular to or substantially perpendicular to the tip surface. The tip surface may be plane or rounded. Further, the earpiece has a second end, also called proximal end. The earpiece may have a proximal surface facing away from the tympanic membrane when worn by the user.

The earpiece may comprise a microphone, also denoted ear canal microphone, connected to a first microphone opening for receiving sound in the ear canal. The first microphone acting as an ear canal microphone may be connected to the first microphone opening via a microphone duct formed by a microphone tube and/or a microphone channel in the earpiece shell.

The earpiece may comprise a receiver opening. The earpiece may comprise a receiver connected to the receiver opening for producing sound in the ear canal. The receiver may be connected to the receiver opening via a receiver duct formed by a receiver tube and/or a receiver channel in the earpiece shell.

The earpiece comprises a vent channel with a vent opening for venting the ear canal.

The second vent opening is arranged in the second end of the earpiece. The first vent opening is arranged in the first end of the earpiece. The vent channel may extend from the second end of the earpiece to the receiver channel and/or to the receiver opening in the first end of the earpiece. The vent channel may be connected with the receiver channel. The vent port may be arranged between the vent channel and the receiver channel.

The vent port may have a length and/or dimension, along a longitudinal axis of the earpiece, of less than 2 mm. The displacement of the closing element may be less than 2 mm.

The earpiece may comprise a dome at the first end. The dome may only have one opening being the receiver channel opening.

The processor may, in a hearing device, be configured for noise reduction etc. The processor may, in a hearing aid, be configured for compensating a hearing loss of the user, for noise reduction etc.

The closing element comprising the first magnetic member may be an actuator, such as a magnetic actuator.

The first magnetic member of the closing element may be a magnetic ring. The first magnetic member may be a permanent magnet. Thus, the state of the closing element may be changed by applying a magnetic field.

The closing element may be an electroacoustic switch. The electroacoustic switch can be realized by a, e.g. mechanically, bi-stable, or with multiple stable states, system, which contains the closing element comprising the first magnetic member, and which is configured for interacting with the second magnetic member. The closing element comprising the first magnetic member may be a magnetic actuator. The second magnetic member may be a coil. The magnetic field of the second magnetic member, e.g. coil, can either attract the closing element comprising the first magnetic member, e.g. magnetic actuator, or push it away—depending on the orientation of the magnetic field of the second magnetic member (coil).

The closing element comprising the first magnetic member, e.g. magnetic actuator, can, e.g. partially, open and close the receiver channel. The receiver channel may be an acoustic channel.

It may be a problem that the switch state of this closing element cannot be determined other than by switching it into the desired position.

Furthermore, it may be a problem, that if the switching could not be performed due to environmental issues, such as wax, or dirt blocking the movement, this would not be electronically detectable.

Thus, it is an advantage that to be able to detect the state of the closing element (switch) without adding additional sensors, the earpiece may comprise a switch state dependent impedance.

The inductive member, e.g. a loop or coil, such as an electrically closed coil, may be mechanically attached to the closing element comprising the first magnetic member, e.g. magnetic actuator, in such a way, that the inductive member is positioned closer, such as inside or around the second magnetic member, e.g. driving coil, in one switch state, while being positioned farther away, such as on top of the second magnetic member, for the other state. The inductive coupling between the inductive member, e.g. loop, and the second magnetic member, e.g. driving coil, will change the electrical measurement value, e.g. impedance, of the system dependent on the switch state.

Thus, the electrical measurement value, e.g. impedance, can be electrically measured and therefore the state of the closing element, e.g. switch, may be determined.

The second magnetic member may be a coil, such as a drive coil or driving coil. The second magnetic member may drive the first magnetic member of the closing element.

The second magnetic member may be arranged inside the receiver channel or outside the receiver channel.

The second magnetic member may be arranged between the vent port and the output of the receiver. Alternatively, the second magnetic member may be arranged between the vent port and the first end of the earpiece.

The second magnetic member may comprise a coil with a number of turns/windings. In some embodiments, the second magnetic member is connected to a current or voltage source.

The current or voltage source may be a DC voltage or current source. When applying the current or voltage to the second magnetic member, the second magnetic member may attract or repel the closing element due to the first magnetic member. For example, a 10 ms burst of DC voltage may change the state, e.g. position, of the closing element.

The inductive member may be a closed loop coil.

The inductive member may comprise one or more windings or turns/windings around the longitudinal axis.

The inductive coupling between the inductive member and the second magnetic member may be provided when current or voltage is applied to the second magnetic member.

The inductive member is arranged in a fixed relationship with the closing member. The inductive member may be arranged around the closing member. The inductive member may be arranged around an outside surface of the closing member. The inductive member may be connected to the closing member. The inductive member may be attached directly to the closing member by connection through a rod.

According to an aspect, disclosed in an earpiece for an ear canal of a user. The earpiece is configured for sealing the ear-canal of the user wearing the earpiece: The earpiece has a first end, the first end facing a tympanic membrane of the ear canal of the user when the earpiece is worn by the user. The earpiece has a second end, the second end facing toward the surroundings of the user when the earpiece is worn by the user. The earpiece comprises a vent channel coupled to a first vent opening positioned at the first end and a second vent opening positioned at the second end. The vent channel comprises a vent port. The earpiece comprises a closing element, the closing element comprising a first magnetic member. The closing element is configured for being in a first state or in a second state, wherein in the first state the closing element causes the vent port to be open, and in the second state the closing element causes the vent port to be closed. The earpiece comprises an inductive member comprising a conductive material, the inductive member being configured in a fixed relationship with the closing member and being configured for inductive coupling with a second magnetic member. The second magnetic member is configured for displacing the closing element by magnetic interaction with the first magnetic member. The earpiece comprises a processor being communicatively coupled to the second magnetic member and configured for obtaining an electrical measurement value of the second magnetic member. The processor is configured for determining the state of the closing element based on the electrical measurement value of the second magnetic member.

In some embodiments, the system and/or the earpiece further comprises:

a memory comprising a first threshold value;

wherein the processor is communicatively coupled to the memory and being configured for obtaining the first threshold value;

wherein the processor is configured to detect that the closing element is in the first state or in the second state based on a comparison between the electrical measurement value and the first threshold value.

The memory may be a digital or an analogue memory.

A first threshold value is provided. Comparing the electrical measurement value and the first threshold value may enable the processor to detect whether the closing element is in the first state, i.e. the vent port is open, or whether the closing element is in the second state, i.e. vent port is closed, or whether the closing element is neither in the first state or in the second state, e.g. failure of closing element, earpiece or system.

In some embodiments, the memory comprises a second threshold value; and wherein the processor is configured to determine that the closing element is in the first state if a first difference between the electrical measurement value and the first threshold value is smaller than a second difference between the electrical measurement value and the second threshold value.

In some embodiments the processor is configured to determine that the closing element is in the second state if the second difference is smaller than the first difference.

In some embodiments, the memory comprises a least one third threshold value between the first threshold value and the second threshold value; and the processor is configured to determine that the closing element is in a third state being between the first state and the second state if a third difference between the electrical measurement value and the third threshold value is smaller than the first difference and the third difference is smaller than the second difference. The third state may be a bi-stable condition i.e. if the vent is to be partially open.

In some embodiments, the electrical measurement value is an electrical impedance of the second magnetic member.

In some embodiments, the first threshold value is a first impedance value.

In some embodiments, the second threshold value is a second impedance value.

In some embodiments, the third threshold value is a third impedance value.

In some embodiments, the system and/or the earpiece further comprises:

a receiver;

a receiver channel coupled to an output of the receiver and extending to a receiver opening in the first end of the earpiece, for providing the audio output signal in the ear canal;

wherein the receiver channel is coupled to the vent channel through the vent port.

In some embodiments, the system and/or the earpiece further comprises:

a microphone connected to an opening in the second end via a microphone channel, for providing an input signal from the surroundings, wherein the processor is configured for processing the input signal; and wherein the receiver is coupled to an output of the processor for conversion of the output signal from the processor into the audio output signal In some embodiments, the earpiece comprises the microphone, and the microphone is connected to an opening in the second end via a microphone channel for providing the input signal from the surroundings.

In some embodiments, the processor is configured to process the input signal according to a hearing loss of a user wearing the earpiece and to provide the output signal based on the processed input signal.

In some embodiments, the earpiece is selected from the group consisting of an ear dome, a hearing protector, an earpiece, and a hearing aid.

In some embodiments, the system is selected from the group consisting of a hearing protector, a headset and a hearing aid.

In some embodiments, the system and/or the earpiece has a longitudinal axis extending between the first end of the earpiece and the second end of the earpiece, and wherein the closing element comprises a passage extending along the longitudinal axis for allowing acoustic waves to propagate through the passage from the output of the receiver to the first end of the earpiece. The acoustic waves may be the audio output signal, sound, from the receiver.

In some embodiments, the first magnetic member comprises a hollow structure having a first end and a second end opposite the first end, wherein the first magnetic member comprises an opening in each of the first and second ends.

In some embodiments, the second magnetic member comprises a coil with a number of windings, and the second magnetic member may be connected to a current or a voltage source. The coil may have a number of windings or turns.

In some embodiments, the number of windings is greater than one.

In some embodiments, the inductive member comprises one or more windings around the longitudinal axis.

In some embodiments, the number of windings is greater than one.

In some embodiments, the inductive coupling between the inductive member and the second magnetic member changes the electrical impedance of the second magnetic member dependent on the state of the closing element.

In some embodiments, the processor is configured for setting the state of the closing element by adjusting a current or a voltage supplied to the second magnetic member.

In some embodiments, the processor is configured for error detection by detecting that the system and/or the earpiece is in the third state. In the third state, the closing element is neither open or closed.

In some embodiments, the system and/or the earpiece further comprises a second microphone connected to an opening in the first end of the earpiece via a second microphone channel for providing a second input signal from the ear canal.

In some embodiments, the processor is configured for setting the state of the closing element based on detection of an own voice signal of the user.

In some embodiments, the processor is configured to detect the own voice signal of the user based on the input signal and the second input signal.

In some embodiments, the processor is configured for detecting a mode of operation of the system and/or of the earpiece. The processor may be configured for setting the state of the closing element according to the mode of operation.

In some embodiments, the processor is configured for receiving a user input setting the mode of operation, and/or the processor is configured for setting the state of the closing element.

In some embodiments, the earpiece comprises a confiner configured for confining a displacement of the closing element in the receiver channel.

In some embodiments, the displacement is along the longitudinal axis.

According to an aspect, disclosed is a hearing device comprising the earpiece according to any of the preceding embodiments.

In some embodiments, the processor is contained in a housing configured to be worn behind the ear of the user. These embodiments may be for behind-the-ear (BTE) hearing devices.

In some embodiments, the receiver is contained in the earpiece, and the receiver is communicatively coupled to the processor via a plurality of wires contained in a cable. These embodiments may be for behind-the-ear (BTE) hearing devices and/or receiver-in-ear (RIE) hearing devices.

In some embodiments, the microphone is contained in the housing.

These embodiments may be for behind-the-ear (BTE) hearing devices.

In some embodiments, the processor is contained in the earpiece. These embodiments may be for in-the-ear (ITE) hearing devices and/or custom hearing devices.

In some embodiments, the receiver is contained in the earpiece, and the receiver is communicatively coupled to the processor.

In some embodiments, the microphone is comprised in the earpiece.

The present disclosure relates to different aspects including the system, earpiece, hearing device, hearing aid, and hearing protection device described above and in the following, and corresponding systems, earpieces, hearing devices, hearing aids, hearing protection devices, methods, and system parts, each yielding one or more of the benefits and advantages described in connection with the first mentioned aspect, and each having one or more embodiments corresponding to the embodiments described in connection with the first mentioned aspect and/or disclosed in the appended claims.

BRIEF DESCRIPTION OF THE DRAWINGS

The above and other features and advantages will become readily apparent to those skilled in the art by the following detailed description of exemplary embodiments thereof with reference to the attached drawings, in which.

DETAILED DESCRIPTION

Figure 1A:
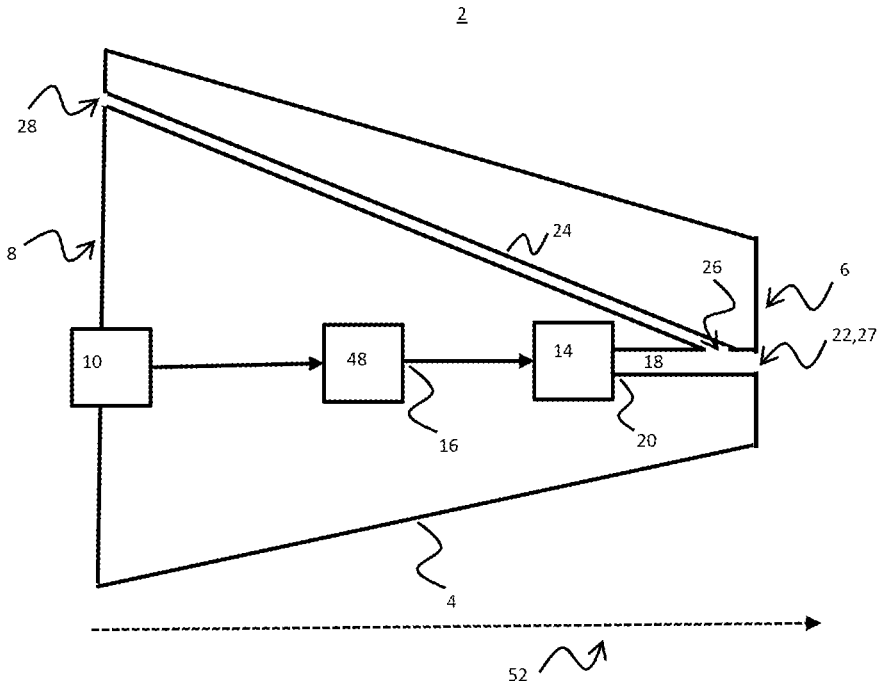
FIGS. 1*a*) and 1*b*) schematically illustrate an example of an earpiece for an ear canal of a user.

Various embodiments are described hereinafter with reference to the figures. Like reference numerals refer to like elements throughout. Like elements will, thus, not be described in detail with respect to the description of each figure. It should also be noted that the figures are only intended to facilitate the description of the embodiments. They are not intended as an exhaustive description of the claimed invention or as a limitation on the scope of the claimed invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

Throughout, the same reference numerals are used for identical or corresponding parts.

Figure 1B:
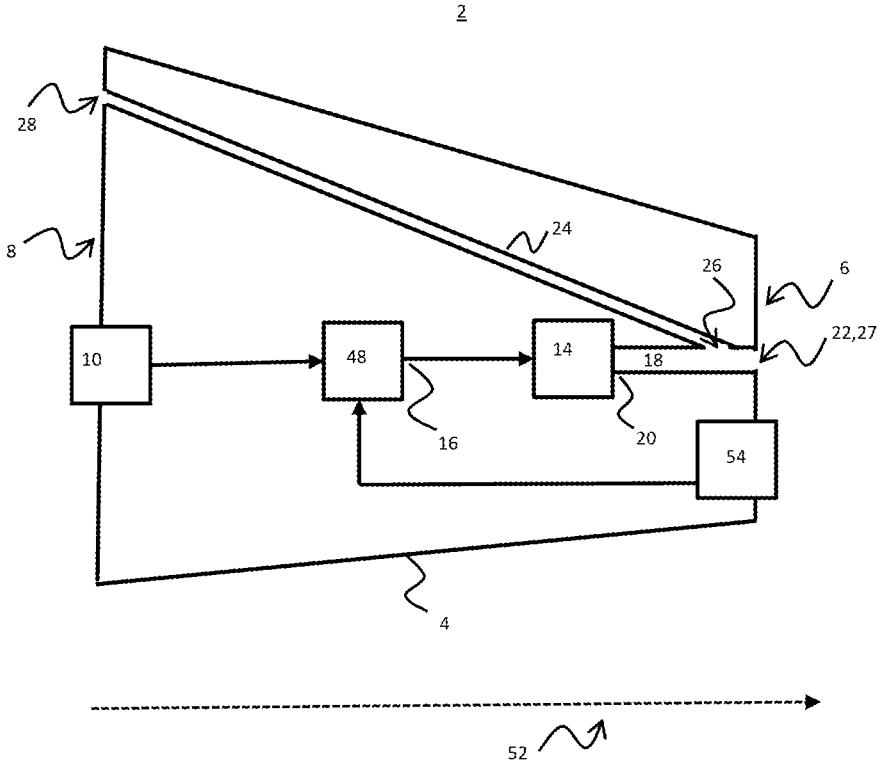

FIG. 1*a*) and FIG. 1*b*) schematically illustrate examples of an earpiece for an ear canal of a user. The earpiece 2 has an earpiece shell 4. The earpiece shell 4 has a first end 6. The first end 6 faces a tympanic membrane of the user, when the earpiece 2 is worn by the user. The earpiece shell 4 has a second end 8. The second end 8 faces toward the surroundings of the user, when the earpiece 2 is worn by the user. The earpiece 2 comprises a microphone 10 arranged in the second end 8 of the earpiece shell 4, where the microphone 10 is for providing an input signal from the surroundings. The earpiece 2 comprises a processor 48 configured for processing the input signal. The earpiece 2 comprises a receiver 14 coupled to an output 16 of the processor 48 for conversion of an output signal from the processor 48 into an audio output signal. The earpiece 2 comprises a receiver channel 18 coupled to an output 20 of the receiver 14 and extending to a receiver opening 22 in the first end 6 of the earpiece 2, where the receiver channel 18 is for providing the audio output signal in the ear canal. The earpiece 2 comprises a vent channel 24 coupled to the receiver channel 18 through a vent port 26. The vent channel 24 has a second vent opening 28 in the second end 8 of the earpiece shell 4. The vent channel 24 has a first vent opening 27 in the first end 6 of the earpiece shell 4. The longitudinal axis 52 of the earpiece 2 is shown.

FIG. 1*b*) further shows that the earpiece 2 comprises a second microphone 54 arranged in the first end 6 of the earpiece shell 4. The second microphone 54 may be connected to an opening in the first end 6 of the earpiece 2. The second microphone 54 is for providing a second input signal from the ear canal of the user. The second input signal from the ear canal of the user may comprise an own voice signal of the user. The processor 48 is configured for processing the second input signal. The processor 48 is configured for setting the state of the closing element, see FIGS. 2-3, based on detection of an own voice signal of the user. The processor 48 is configured to detect the own voice signal of the user based on the input signal and the second input signal.

Figure 2A:
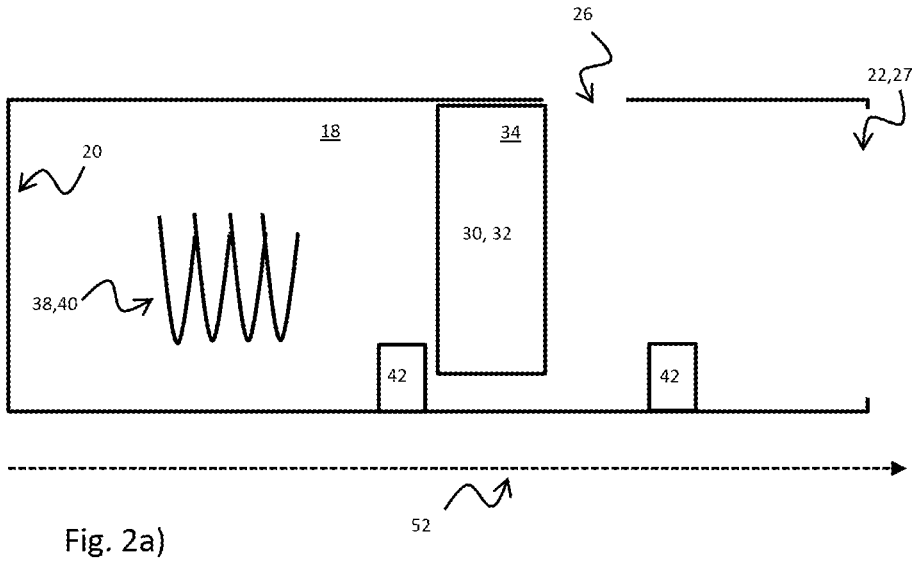
FIGS. 2*a*) and 2*b*) schematically illustrate an example of an earpiece receiver channel with a closing element, and second magnetic member.
Figure 2B:
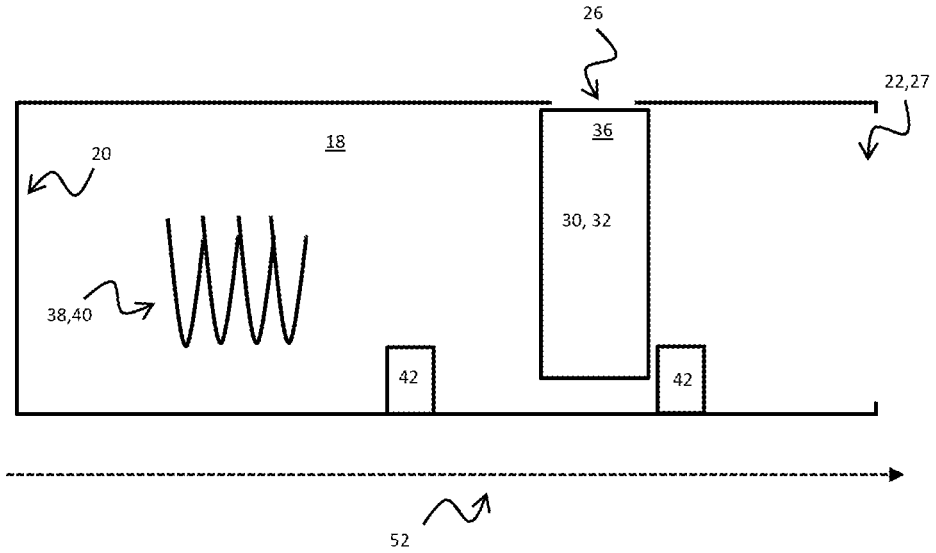

FIGS. 2*a*) and 2*b*) schematically illustrates an example of a receiver channel 18. The receiver channel 18 comprises a closing element 30. The closing element 30 comprises a first magnetic member 32. The closing element 30 is configured for being in a first state 34 or in a second state 36. In the first state 34, the closing element 30 causes the vent port 26 to be open. In the second state 36, the closing element 30 causes the vent port 26 to be closed.

In an embodiment, the closing element 30 is hollow and open in an end facing the tympanic membrane and in an end facing the receiver such that an acoustic signal from the receiver may pass through the closing element when the closing element is in an open state i.e. where the vent port 26 is open, and when the closing element is in a closed state i.e. where the vent port 26 is closed.

In an embodiment, the closing element 30 may be a hollow cylinder with a radius r being smaller than a radius R of the receiver channel and a height h smaller than a longitudinal distance H between a first and a second confiner 42. The hollow cylinder may be positioned such that its longitudinal axis 52 along the height h is along the receiver channel 18. In an embodiment, the radius r is smaller than the radius R if $0.75*R<r<0.99*R$. In an embodiment, the height h is smaller than the distance H if $0.75*H<h<0.99*H$.

The earpiece comprises a second magnetic member 38 arranged for displacing the closing element 30 by magnetic interaction with the first magnetic member 32 of the closing element 30.

The second magnetic member 38 is configured to attract or repel the first magnetic member 32 of the closing element 30, when a magnetic field is applied, thereby moving the closing element 30. Moving the closing element 30 provides that the closing element 30 changes or switches between the first state 34 and the second state 36. Changing the state of the closing element 30 provides that the vent port 26 changes between being open, FIG. 2*a*), or closed, FIG. 2*b*).

The second magnetic member 38 may be a coil, such as a drive coil or driving coil. The second magnetic member 38 may drive the first magnetic member 32 of the closing element 30. In an embodiment, the second magnetic member 38 is arranged inside the receiver channel 18. In an embodiment, the second magnetic member 38 can be arranged outside the receiver channel 18.

In an embodiment, the second magnetic member 18 is arranged between the vent port 26 and the output 20 of the receiver 14. In an embodiment, the second magnetic member 38 may be arranged between the vent port 26 and the receiver opening 22.

The second magnetic member 38 comprises a coil 40 with a number of turns/windings.

The second magnetic member 38 may be connected to a current or voltage source. The current or voltage source may be a DC voltage or current source. When applying the current or voltage to the second magnetic member 38, the second magnetic member 38 may attract or repel the closing element 30 due to the first magnetic member 32. For example, a 10 ms burst of DC voltage may change the state 34, 36, e.g. position, of the closing element 30. In an embodiment, the current or voltage source may be a power source of the earpiece such as a battery or a rechargeable battery. In an embodiment, the current or voltage source may provide power to the microphone and/or the receiver and/or the processor 48 and the second magnetic member 38.

The earpiece comprises confiners 42 configured for confining the displacement of the closing element 30 in the receiver channel 18. The confiners 42 may comprise stopping elements and/or constrictions in the receiver channel 18.

Figure 3A:
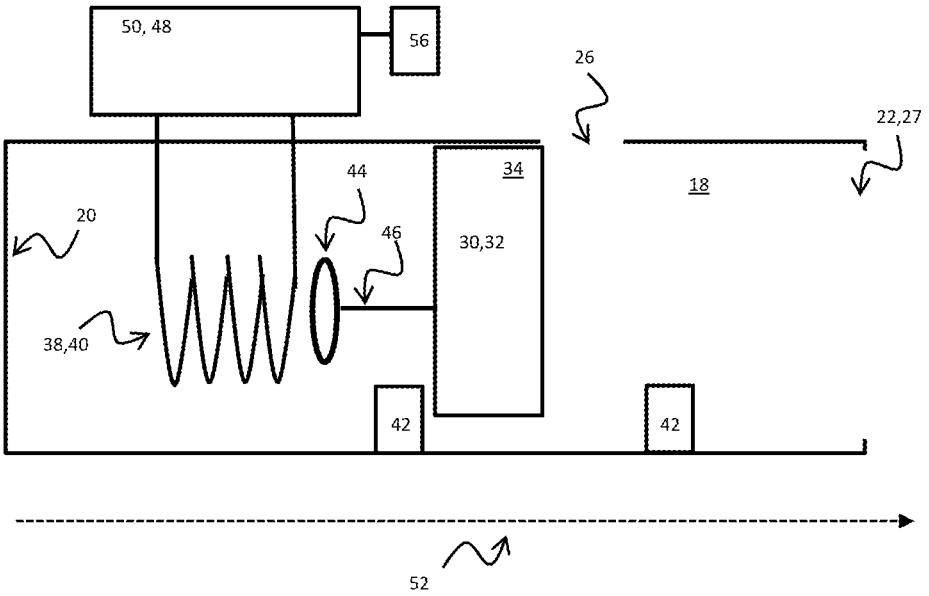
FIGS. 3*a*) and 3*b*) schematically illustrate an example of an earpiece receiver channel with a closing element, second magnetic member and inductive member.

FIGS. 3*a*) and 3*b*) schematically illustrates an embodiment of a receiver channel 18. The receiver channel 18 comprises a closing element 30. The closing element 30 comprises a first magnetic member 32. The closing element 30 is configured for being in a first state 34 or in a second state 36. In the first state 34, the closing element 30 causes the vent port 26 to be open. In the second state 36, the closing element 30 causes the vent port 26 to be closed.

In an embodiment, the closing element 30 is hollow and open in an end facing the tympanic membrane and in an end facing the receiver such that an acoustic signal from the receiver may pass through the closing element when the closing element is in an open state i.e. where the vent port 26 is open, and when the closing element is in a closed state i.e. where the vent port 26 is closed.

In an embodiment, the closing element 30 may be a hollow cylinder with a radius r being smaller than a radius R of the receiver channel and a height h smaller than a longitudinal distance H between a first and a second confiner 42. The hollow cylinder may be positioned such that its longitudinal axis 52 along the height h is along the receiver channel 18. In an embodiment, the radius r is smaller than the radius R if $0.75*R<r<0.99*R$. In an embodiment, the height h is smaller than the distance H if $0.75*H<h<0.99*H$.

The earpiece comprises a second magnetic member 38 arranged for displacing the closing element 30 by magnetic interaction with the first magnetic member 32 of the closing element 30.

The second magnetic member 38 is configured to attract or repel the first magnetic member 32 of the closing element 30, when a magnetic field is applied, thereby moving the closing element 30. Moving the closing element 30 provides that the closing element 30 changes or switches between the first state 34 and the second state 36. Changing the state of the closing element 30 provides that the vent port 26 changes between being open, FIG. 3*a*), or closed, FIG. 3*b*).

The second magnetic member 38 may be a coil, such as a drive coil or driving coil. The second magnetic member 38 may drive the first magnetic member 32 of the closing element 30. The second magnetic member 38 is arranged inside the receiver channel 18. Alternatively, second magnetic member 38 can be arranged outside the receiver channel 18.

The second magnetic member 38 is arranged between the vent port 26 and the output 20 of the receiver 14. Alternatively, the second magnetic member 38 may be arranged between the vent port 26 and the receiver opening 22.

The second magnetic member 38 comprises a coil 40 with a number of turns/windings.

The second magnetic member 38 is connected to a current/voltage source 50. The current or voltage source 50 may be a DC voltage or current source. When applying the current or voltage to the second magnetic member 38, the second magnetic member 38 may attract or repel the closing element 30 due to the first magnetic member 32. For example, a 10 ms burst of DC voltage may change the state 34, 36, e.g. position, of the closing element 30. In an embodiment, the current or voltage source 50 may be a power source of the earpiece such as a battery or a rechargeable battery. In an embodiment, the current or voltage source may provide power to the second magnetic member 38 and the microphone and/or the receiver and/or the processor 48.

The earpiece comprises confiners 42 configured for confining the displacement of the closing element 30 in the receiver channel 18. The confiners 42 may comprise stopping elements and/or constrictions in the receiver channel 18.

The earpiece comprises an inductive member 44 comprising a conductive material, where the inductive member 44 is arranged in a fixed relationship with the closing member 30 and is arranged for inductive coupling with the second magnetic member 38.

The inductive member 44 is a closed loop coil. The inductive member may comprise one or more turns/windings around the longitudinal axis 52.

The inductive coupling between the inductive member 44 and the second magnetic member 38 may be provided when current or voltage is applied to the second magnetic member 38 through the current/voltage source 50.

The inductive member 44 is connected to the closing member 30. The inductive member 44 is attached directly to the closing member 30 by connection through a rod 46. Alternatively, the inductive member 44 may be arranged around the closing member 30, such as arranged around an outside surface of the closing member 30.

The fixed relationship between the inductive member 44 and the closing element 30 provides that when the closing element 30 moves the inductive member 44 relative to the second magnetic member 38, the inductive coupling between the second magnetic member 38 and the inductive member 44 changes, and thereby the electrical measurement value, e.g. impedance, of the second magnetic member 38 changes accordingly.

This change in the electrical measurement value, e.g. impedance, can be detected or determined by the processor 48 connected to the second magnetic member 38.

The processor 48 is configured for determining the state of the closing element 30 based on the electrical measurement value, e.g. impedance, of the second magnetic member 38.

The processor 48 is configured for setting the state 34, 36 of the closing element 30 by adjusting a current or voltage supplied from the current/voltage source 42 to the second magnetic member 38.

The processor 48 is configured to detect that the closing element 30 changes from the first state 34, i.e. vent port 26 open, to the second state 36, i.e. vent port 26 closed, by detecting a decrease in the electrical measurement value, e.g. impedance, of the second magnetic member 38.

The processor 48 is configured to detect that the closing element 30 changes from the second state 36, i.e. vent port 26 closed, to the first state 34, i.e. vent port 26 open, by detecting an increase in the electrical measurement value, e.g. impedance, of the second magnetic member 38.

The earpiece 2 or system comprises a memory 56. The memory comprises one or more threshold values, such as a first threshold value, a second threshold value, and a third threshold value. The processor 48 is communicatively coupled to the memory 56 and is configured for obtaining the one or more threshold values.

Figure 3B:
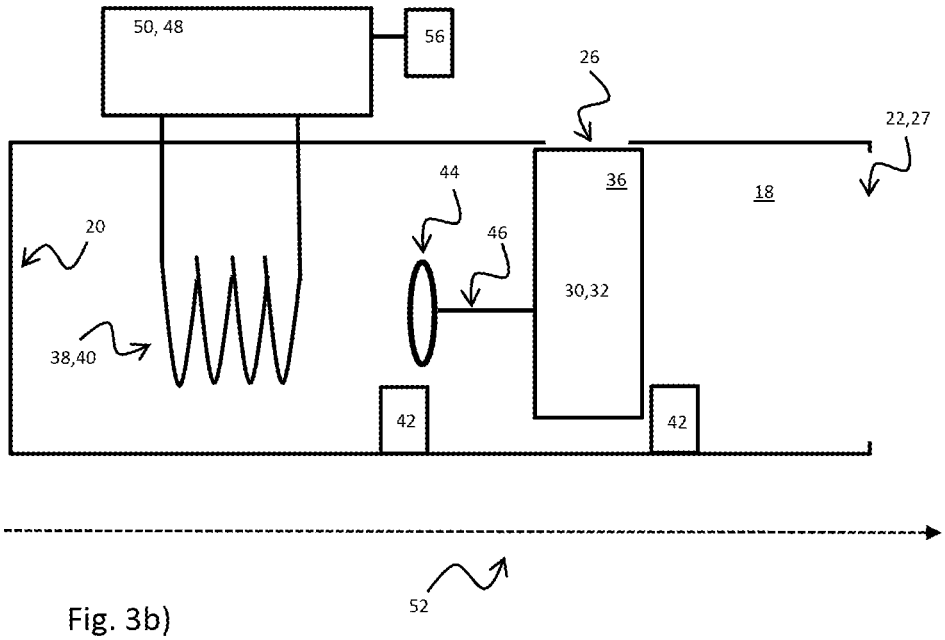
FIG. 3*c*) schematically illustrates an example of a receiver channel.
Figure 3C:
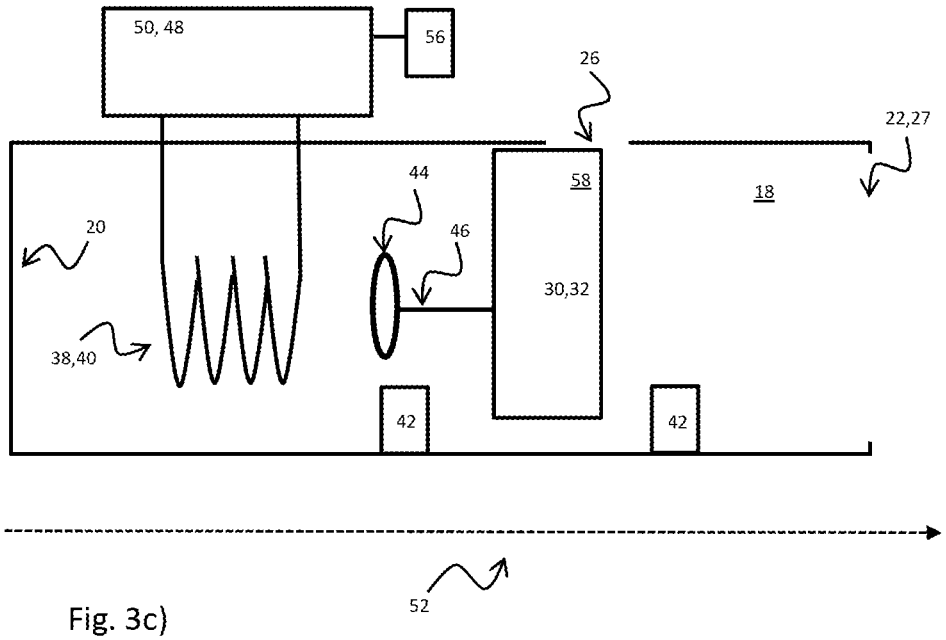

FIG. 3*c*) schematically illustrates an embodiment of a receiver channel 18. The receiver channel 18 comprises a closing element 30. The receiver channel 18 further comprises the features of FIGS. 3*a*) and 3*b*). As shown on FIGS. 3*a*) and 3*b*), the closing element 30 is configured for being in a first state 34 or in a second state 36. In the first state 34, the closing element 30 causes the vent port 26 to be open. In the second state 36, the closing element 30 causes the vent port 26 to be closed.

FIG. 3*c*) illustrates an example where the closing element 30 is in a third state 58. In the third state 58, the closing element 30 is neither in the open state 34 (FIG. 3*a*) nor in the closed 36 state (FIG. 3*b*). Thus, in the third state 58, the vent port 26 is neither open nor closed. In the third state 58, the vent port 26 may be half-open or half-closed, such as partially open. In the third state 58, the closing element 30 is between the first state 34 and the second state 36.

If the closing element 30 is in the third state 58, this may be an error, e.g. caused by the receiver channel 18 being blocked by e.g. ear wax, dust or the like, providing that the closing element 30 cannot move freely in the receiver channel 18.

The processor 48 may be configured for detecting that the closing element 30 is in the third state 58. Thus, the processor 48 may be configured for error detection by detecting that the system and/or the earpiece 2 and/or closing element 30 is in the third state 58. The processor 48 may be configured to determine that the closing element 30 is in the third state 58, being between the first state 34 and the second state 36, if a third difference between the electrical measurement value and the third threshold value is smaller than the first difference, and the third difference is smaller than the second difference, where the third threshold value is between the first threshold value and the second threshold value. Thus, this enables error detection if the processor 48 determines that the closing element 30 is in a third state 58 i.e. neither in the open state 34 nor in the closed state 36.

In an embodiment, the third state 58 may be used to enable a partially open vent port 26. The processor 48 may receive an input from a user indicating that the vent port 26 should be partially open, e.g. received via an external communication device communicatively coupled to the system or a button on the system or the like. The processor 48 may determine that the vent port 26 should be partially open based on a sound environment detected by the system or any other parameter detectable by the system. Based on the input and/or the determination, the processor 48 may be configured to control the second magnetic member 38 to displace the closing element 30 from the first state 34 to the second state 36 or from the second state 36 to the first state 34 until the processor 48 detects that the closing element 30 is in the third state 58. Thereby, the vent channel 24 may be set in a partially open state i.e. the third state 58.

Figure 4:
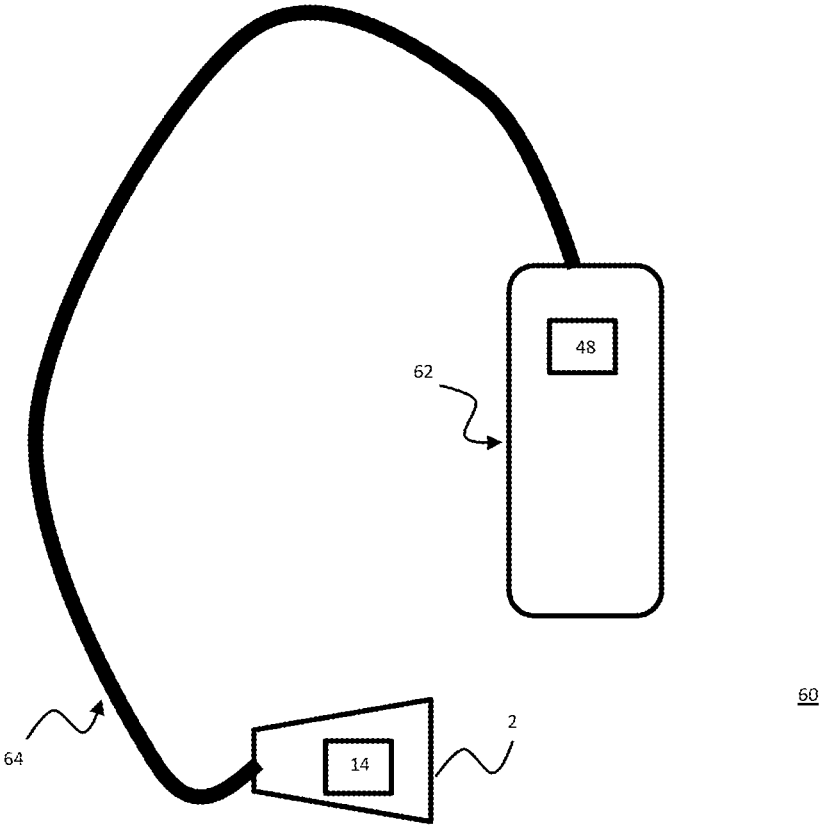
FIG. 4 schematically illustrates a receiver in the ear (RIE) hearing device comprising the earpiece.

FIG. 4 schematically illustrates a receiver in the ear (RIE) hearing device 60 comprising the earpiece 2. The earpiece 2 is according to any of the FIG. 3*a*), 3*b*), or 3*c*).

In FIGS. 1*a*) and 1*b*), an embodiment was shown where the processor 48 is provided in the earpiece 2.

This FIG. 4 shows an embodiment where the processor 48 is contained in a housing 62 configured to be worn behind the ear of the user.

The receiver 14 is contained in the earpiece, as shown in FIGS. 1*a*) and 1*b*), and the receiver 14 is communicatively coupled to the processor 48 in the housing 62 via a plurality of wires contained in a cable 64.

Thus, the hearing device 60 is a behind the ear (BTE) hearing device having a housing 62 comprising the processor 48 connected with the receiver 14 in the earpiece 2.

Although particular features have been shown and described, it will be understood that they are not intended to limit the claimed invention, and it will be made obvious to those skilled in the art that various changes and modifications may be made without departing from the scope of the claimed invention. The specification and drawings are, accordingly to be regarded in an illustrative rather than restrictive sense. The claimed invention is intended to cover all alternatives, modifications and equivalents.

Items

1. An earpiece for an ear canal of a user, the earpiece is configured for sealing the ear-canal of the user wearing the earpiece, the earpiece having a first end, the first end facing a tympanic membrane of the ear canal of the user when the earpiece is worn by the user, the earpiece having a second end, the second end facing toward the surroundings of the user when the earpiece is worn by the user, the earpiece comprising:

a vent channel coupled to a first vent opening positioned at the first end and a second vent opening positioned at the second end, wherein the vent channel comprises a vent port;

a closing element, the closing element comprising a first magnetic member, wherein the closing element is configured for being in a first state or in a second state, wherein in the first state the closing element causes the vent port to be open, and in the second state the closing element causes the vent port to be closed;

an inductive member comprising a conductive material, the inductive member being configured in a fixed relationship with the closing member and being configured for inductive coupling with a second magnetic member;

the second magnetic member is configured for displacing the closing element by magnetic interaction with the first magnetic member;

a processor being communicatively coupled to the second magnetic member and configured for obtaining an electrical measurement value of the second magnetic member; and wherein the processor is configured for determining the state of the closing element based on the electrical measurement value of the second magnetic member.

2. An earpiece according to item 1, wherein the earpiece further comprises a memory comprising a first threshold value;

wherein the processor is communicatively coupled to the memory and being configured for obtaining the first threshold value;

wherein the processor is configured to detect that the closing element is in the first state or in the second state based on a comparison between the electrical measurement value and the first threshold value.

3. An earpiece according to item 2, wherein the memory comprises a second threshold value; and wherein the processor is configured to determine that the closing element is in the first state if a first difference between the electrical measurement value and the first threshold value is smaller than a second difference between the electrical measurement value and the second threshold value.

4. An earpiece according to item 3, wherein the processor is configured to determine that the closing element is in the second state if the second difference is smaller than the first difference.

5. An earpiece according to item 4, wherein the memory comprises a least one third threshold value between the first threshold value and the second threshold value;

wherein the processor is configured to determine that the closing element is in a third state being between the first state and the second state if a third difference between the electrical measurement value and the third threshold value is smaller than the first difference and the third difference is smaller than the second difference.

6. An earpiece according to item 1, wherein the electrical measurement value is an electrical impedance of the second magnetic member.

7. An earpiece according to item 2, wherein the first threshold value is a first impedance value.

8. An earpiece according to item 3, wherein the second threshold value is a second impedance value.

9. An earpiece according to item 5, wherein the third threshold value is a third impedance value.

10. An earpiece according to anyone of the preceding items, wherein the earpiece further comprises:

a receiver;

a receiver channel coupled to an output of the receiver and extending to a receiver opening in the first end of the earpiece, for providing the audio output signal in the ear canal;

wherein the receiver channel is coupled to the vent channel through the vent port.

11. An earpiece according to item 10, wherein the earpiece further comprises:

a microphone connected to an opening in the second end via a microphone channel, for providing an input signal from the surroundings, wherein the processor is configured for processing the input signal; and wherein the receiver is coupled to an output of the processor for conversion of the output signal from the processor into the audio output signal 12. An earpiece according to item 11, wherein the processor is configured to process the input signal according to a hearing loss of a user wearing the earpiece and to provide the output signal based on the processed input signal.

13. An earpiece according to anyone of the preceding items, wherein the earpiece is selected from the group consisting of an ear dome, a hearing protector, an earpiece, and a hearing aid.

14. An earpiece according to any of the preceding items, wherein the earpiece has a longitudinal axis extending between the first end of the earpiece and the second end of the earpiece, and wherein the closing element comprises a passage extending along the longitudinal axis for allowing acoustic waves to propagate through the passage from the output of the receiver to the first end of the earpiece.

15. An earpiece according to any of the preceding items, wherein the first magnetic member comprises a hollow structure having a first end and a second end opposite the first end, wherein the first magnetic member comprises an opening in each of the first and second ends.

16. An earpiece according to anyone of the preceding items, wherein the second magnetic member comprises a coil with a number of windings, and the second magnetic member is connected to a current or a voltage source.

17. An earpiece according to item 14, wherein the inductive member comprises one or more windings around the longitudinal axis.

18. An earpiece according to anyone of the preceding items, wherein the inductive coupling between the inductive member and the second magnetic member changes the electrical impedance of the second magnetic member dependent on the state of the closing element.

19. An earpiece according to anyone of the preceding items, wherein the processor is configured for setting the state of the closing element by adjusting a current or a voltage supplied to the second magnetic member.

20. An earpiece according to anyone of the preceding items when dependent on item 5, wherein the processor is configured for error detection by detecting that the earpiece is in the third state.

21. An earpiece according to anyone of the preceding items, wherein the earpiece further comprises a second microphone connected to an opening in the first end of the earpiece via a second microphone channel for providing a second input signal from the ear canal.

22. An earpiece according to item 21, wherein the processor is configured for setting the state of the closing element based on detection of an own voice signal of the user.

23. An earpiece according to item 22, wherein the processor is configured to detect the own voice signal of the user based on the input signal and the second input signal.

24. An earpiece according to anyone of the preceding items, wherein the processor is configured for detecting a mode of operation of the earpiece, and setting the state of the closing element according to the mode of operation.

25. An earpiece according to item 24, wherein the processor is configured for receiving a user input setting the mode of operation and/or setting the state of the closing element.

26. An earpiece according to any of the preceding items, wherein the earpiece comprises a confiner configured for confining a displacement of the closing element in the receiver channel.

27. A hearing device comprising the earpiece according to any of the preceding items.

28. A system comprising an earpiece for an ear canal of a user, the earpiece is configured for sealing the ear-canal of the user wearing the earpiece, the earpiece having a first end, the first end facing a tympanic membrane of the ear canal of the user when the earpiece is worn by the user, the earpiece having a second end, the second end facing toward the surroundings of the user when the earpiece is worn by the user, wherein the earpiece comprises:

a vent channel coupled to a first vent opening positioned at the first end and a second vent opening positioned at the second end, wherein the vent channel comprises a vent port;

a closing element, the closing element comprising a first magnetic member, wherein the closing element is configured for being in a first state or in a second state, wherein in the first state the closing element causes the vent port to be open, and in the second state the closing element causes the vent port to be closed;

an inductive member comprising a conductive material, the inductive member being configured in a fixed relationship with the closing member and being configured for inductive coupling with a second magnetic member;

the second magnetic member is configured for displacing the closing element by magnetic interaction with the first magnetic member;

wherein the system comprises:

a processor being communicatively coupled to the second magnetic member and configured for obtaining an electrical measurement value of the second magnetic member; and wherein the processor is configured for determining the state of the closing element based on the electrical measurement value of the second magnetic member.

29. A system according to item 28, wherein the system further comprises a memory comprising a first threshold value;

wherein the processor is communicatively coupled to the memory and being configured for obtaining the first threshold value;

wherein the processor is configured to detect that the closing element is in the first state or in the second state based on a comparison between the electrical measurement value and the first threshold value.

30. A system according to item 29, wherein the memory comprises a second threshold value; and wherein the processor is configured to determine that the closing element is in the first state if a first difference between the electrical measurement value and the first threshold value is smaller than a second difference between the electrical measurement value and the second threshold value.

31. A system according to item 30, wherein the processor is configured to determine that the closing element is in the second state if the second difference is smaller than the first difference.

32. A system according to item 31, wherein the memory comprises a least one third threshold value between the first threshold value and the second threshold value;

wherein the processor is configured to determine that the closing element is in a third state being between the first state and the second state if a third difference between the electrical measurement value and the third threshold value is smaller than the first difference and the third difference is smaller than the second difference.

33. A system according to item 28, wherein the electrical measurement value is an electrical impedance of the second magnetic member.

34. A system according to item 29, wherein the first threshold value is a first impedance value.

35. A system according to item 30, wherein the second threshold value is a second impedance value.

36. A system according to item 32, wherein the third threshold value is a third impedance value.

37. A system according to anyone of items 28 to 36, wherein the system further comprises a receiver;

wherein the earpiece further comprises a receiver channel coupled to an output of the receiver and extending to a receiver opening in the first end of the earpiece, for providing the audio output signal in the ear canal;

wherein the receiver channel is coupled to the vent channel through the vent port.

38. A system according to item 37, wherein the system further comprises a microphone oriented towards surroundings of the user for providing an input signal;

wherein the processor is configured for processing the input signal; and wherein the receiver is coupled to an output of the processor for conversion of the output signal from the processor into the audio output signal.

39. A system according to item 38, wherein the earpiece comprises the microphone and wherein the microphone is connected to an opening in the second end via a microphone channel for providing the input signal from the surroundings.

40. A system according to item 38 or 39, wherein the processor is configured to process the input signal according to a hearing loss of a user wearing the earpiece and to provide the output signal based on the processed input signal.

41. A system according to anyone of items 28 to 40, wherein the system is selected from the group consisting of a hearing protector, a headset and a hearing aid.

42. A system according to anyone of items 28-41, wherein the system has a longitudinal axis extending between the first end of the earpiece and the second end of the earpiece, and wherein the closing element comprises a passage extending along the longitudinal axis for allowing acoustic waves to propagate through the passage from the output of the receiver to the first end of the earpiece.

43. A system according to anyone of items 28 to 42, wherein the first magnetic member comprises a hollow structure having a first end and a second end opposite the first end, wherein the first magnetic member comprises an opening in each of the first and second ends.

44. A system according to anyone of items 28 to 43, wherein the second magnetic member comprises a coil with a number of windings, and the second magnetic member is connected to a current or a voltage source.

45. A system according to item 44, wherein the number of windings is greater than one.

46. A system according to item 42, wherein the inductive member comprises one or more windings around the longitudinal axis.

47. A system according to item 46, wherein the number of windings is greater than one.

48. A system according to any of the preceding items, wherein the inductive coupling between the inductive member and the second magnetic member changes the electrical impedance of the second magnetic member dependent on the state of the closing element.

49. A system according to anyone of items 28 to 48, wherein the processor is configured for setting the state of the closing element by adjusting a current or a voltage supplied to the second magnetic member.

50. A system according to anyone of items 28 to 49 when dependent on item 32, wherein the processor is configured for error detection by detecting that the system is in the third state.

51. A system according to anyone of items 28 to 50, wherein the earpiece further comprises a second microphone connected to an opening in the first end of the earpiece via a second microphone channel for providing a second input signal from the ear canal.

52. A system according to item 51, wherein the processor is configured for setting the state of the closing element based on detection of an own voice signal of the user.

53. A system according to item 52, wherein the processor is configured to detect the own voice signal of the user based on the input signal and the second input signal.

54. A system according to anyone of items 28 to 53, wherein the processor is configured for detecting a mode of operation of the system, and setting the state of the closing element according to the mode of operation.

55. A system according to item 54, wherein the processor is configured for receiving a user input setting the mode of operation and/or setting the state of the closing element.

56. A system according to any of items 28 to 55, wherein the earpiece comprises a confiner configured for confining a displacement of the closing element in the receiver channel.

57. A system according to item 56 when dependent on item 42, wherein the displacement is along the longitudinal axis.

58. A system according to anyone of items 28 to 57, wherein the processor is contained in a housing configured to be worn behind the ear of the user.

59. A system according to item 58 when dependent on item 37, wherein the receiver is contained in the earpiece, and wherein the receiver is communicatively coupled to the processor via a plurality of wires contained in a cable.

60. A system according to item 58 when dependent on item 38 or item 59 when dependent on item 38, wherein the microphone is contained in the housing.

61. A system according to anyone of items 28-38, wherein the processor is contained in the earpiece.

62. A system according to item 61 when dependent on item 38, wherein the receiver is contained in the earpiece, and wherein the receiver is communicatively coupled to the processor.

63. A system according to item 61 when dependent on item 38 or item 62 when dependent on item 38, wherein the microphone is comprised in the earpiece.

LIST OF REFERENCES

2 earpiece
4 earpiece shell
6 first end
8 second end
10 microphone
14 receiver
16 output of the processor
18 receiver channel
20 output of the receiver
22 receiver opening
24 vent channel
26 vent port
27 first vent opening
28 second vent opening
30 closing element
32 first magnetic member
34 first state of closing element
36 second state of closing element
38 second magnetic member
40 coil of second magnetic member
42 confiners
44 inductive member
46 rod connecting inductive member and closing element
48 processor
50 current/voltage source
52 longitudinal axis
54 second microphone
56 memory
58 third state of closing element
60 RIE hearing device
62 BTE housing

The invention claimed is:

1. An earpiece for an ear canal of a user, the earpiece having a first end and a second end, the earpiece comprising:

a vent channel having a vent port;

a closing element, the closing element comprising a first magnetic member, wherein the closing element is configured to cause the vent port to be open when the closing element is in a first state, and is configured to cause the vent port to be closed when the closing element is in a second state; and an inductive member comprising a conductive material, the inductive member being configured for inductive coupling with a second magnetic member, wherein the second magnetic member is configured for moving the closing element by magnetic interaction with the first magnetic member.

2. The earpiece according to claim 1, further comprising a processing unit configured to obtain an electrical measurement value associated with the second magnetic member.

3. The earpiece according to claim 2, wherein the processing unit is configured to determine whether the closing element is in the first state or the second state based on the electrical measurement value.

4. The earpiece according to claim 3, further comprising a memory storing a first threshold value;

wherein the processing unit is communicatively coupled to the memory, and is configured to obtain the first threshold value from the memory; and wherein the processing unit is configured to detect that the closing element is in the first state or in the second state based on a comparison between the electrical measurement value and the first threshold value.

5. The earpiece according to claim 4, wherein the memory comprises a second threshold value; and wherein the processing unit is configured to determine that the closing element is in the first state if a first difference between the electrical measurement value and the first threshold value is smaller than a second difference between the electrical measurement value and the second threshold value.

6. The earpiece according to claim 5, wherein the processing unit is configured to determine that the closing element is in the second state if the second difference is smaller than the first difference.

7. The earpiece according to claim 6, wherein the memory comprises at least one third threshold value between the first threshold value and the second threshold value; and wherein the processing unit is configured to determine that the closing element is in a third state if a third difference between the electrical measurement value and the third threshold value is smaller than the first difference, and if the third difference is smaller than the second difference.

8. The earpiece according to claim 1, further comprising a receiver;

wherein the earpiece further comprises a receiver channel coupled to an output of the receiver and extending to a receiver opening in the first end of the earpiece, for providing an audio output signal; and wherein the receiver channel is coupled to the vent channel through the vent port.

9. The earpiece according to claim 1, further comprising a processing unit, and a microphone oriented towards a surrounding of the user for providing an input signal;

wherein the processing unit is configured to provide an output signal based on the input signal; and wherein the earpiece further comprises a receiver configured to provide an audio output signal based on the output signal.

10. The earpiece according to claim 1, further comprising a receiver, wherein the earpiece has a longitudinal axis extending between the first end of the earpiece and the second end of the earpiece, and wherein the closing element comprises a passage extending along the longitudinal axis for allowing acoustic waves to propagate through the passage from an output of the receiver to the first end of the earpiece.

11. The earpiece according to claim 1, wherein the first magnetic member comprises a hollow structure having a first end and a second end opposite the first end of the hollow structure, wherein the first magnetic member comprises an opening in each of the first and second ends of the hollow structure.

12. The earpiece according to claim 1, wherein the second magnetic member comprises a coil with a plurality of windings, and the second magnetic member is connected to a current or a voltage source.

13. The earpiece according to claim 12, wherein the inductive coupling between the inductive member and the second magnetic member is configured to change an electrical impedance of the second magnetic member.

14. The earpiece according to claim 1, further comprising a processing unit configured to selectively place the closing element in the first state or in the second state by adjusting a current or a voltage supplied to the second magnetic member.

15. The earpiece according to claim 1, further comprising a processing unit configured for error detection by detecting whether the closing element is in a certain state.

16. The earpiece according to claim 1, wherein the earpiece comprises a receiver channel, and a confiner configured to confine a movement of the closing element in the receiver channel.

17. The earpiece according to claim 16, wherein the movement is along a longitudinal axis of the earpiece.

18. The earpiece according to claim 1, wherein the earpiece is configured for sealing the ear canal of the user when the user wears the earpiece.

19. The earpiece according to claim 1, wherein the inductive member is in a fixed relationship with the closing member.

20. An earpiece having a first end and a second end, the earpiece comprising:

a vent channel comprising a vent port;

a closing element, the closing element comprising a first magnetic member, wherein the closing element is configured to cause the vent port to be open when the closing element is in a first state, and is configured to cause the vent port to be closed when the closing element is in a second state;

an inductive member comprising a conductive material, the inductive member being in a fixed positional relationship with respect to the first magnetic member, wherein the second magnetic member is configured for moving the closing element by magnetic interaction with the first magnetic member; and a processing unit configured to adjust a current or a voltage for the second magnetic member to selectively place the closing element in the first state or in the second state.

* * * * *